US010166687B2

(12) United States Patent
Chen

(10) Patent No.: US 10,166,687 B2
(45) Date of Patent: Jan. 1, 2019

(54) CURTAIN CUTTING AID

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 152 days.

(21) Appl. No.: 15/243,381

(22) Filed: Aug. 22, 2016

(65) Prior Publication Data

US 2017/0057109 A1 Mar. 2, 2017

(30) Foreign Application Priority Data

Sep. 2, 2015 (TW) ..... 104128996 A

(51) Int. Cl.
*B26B 29/06* (2006.01)
*B26D 7/01* (2006.01)
*B26D 7/02* (2006.01)

(52) U.S. Cl.
CPC ..... *B26B 29/06* (2013.01); *B26D 7/016* (2013.01); *B26D 7/02* (2013.01)

(58) Field of Classification Search
CPC .. A41H 15/00; B23D 2023/005; B23D 23/00; B25B 5/103; B25B 5/166; B25B 29/06; B26D 7/015; B26D 7/016; B26D 7/02; B26D 7/04; B26D 7/025
See application file for complete search history.

(56) References Cited

U.S. PATENT DOCUMENTS 1,689,331 A * 10/1928 Disibio ..... B25B 5/102 24/569
3,790,121 A * 2/1974 Sels ..... E04G 13/025 249/219.1
4,244,255 A * 1/1981 Dykstra ..... B26D 5/10 83/629
5,339,716 A * 8/1994 Sands ..... E06B 9/266 29/24.5
5,634,387 A * 6/1997 Squires ..... B23D 15/06 83/468
5,799,557 A * 9/1998 Wang ..... B23D 23/00 29/24.5
6,334,379 B1 * 1/2002 Sudano ..... B23D 23/00 29/24.5

(Continued)

*Primary Examiner* — Tyrone V Hall, Jr.
(74) *Attorney, Agent, or Firm* — Muncy, Geissler, Olds & Lowe, P.C.

(57) ABSTRACT

A curtain cutting aid includes a curtain holder including an insertion space, an insertion slot in communication with the insertion space and a positioning portion disposed between the insertion space and the insertion slot, and a positioning unit including a movable bar inserted through the insertion slot into the insertion space and provided with spaced positioning grooves and an operating knob mounted in the curtain holder and coupled with the movable bar and movable between an initial position where one positioning groove of the movable bar is engaged with the positioning portion of the curtain holder to lock the movable bar in the insertion space, and a pressed position where the positioning groove of the movable bar is disengaged from the positioning portion of the curtain holder for allowing adjustment of the position of the movable bar according to the size of the curtain to be cut.

5 Claims, 7 Drawing Sheets

(56) References Cited

U.S. PATENT DOCUMENTS

| | | | | |
|---|---|---|---|---|
| 2003/0025262 | A1* | 2/2003 | Kranzler | B25B 5/101 269/249 |
| 2012/0047714 | A1* | 3/2012 | Barillaro | B25B 5/101 29/559 |
| 2015/0102546 | A1* | 4/2015 | Chen | B26B 29/06 269/234 |
| 2016/0121461 | A1* | 5/2016 | Bartl | B25B 5/10 269/210 |

* cited by examiner

CURTAIN CUTTING AID

BACKGROUND OF THE INVENTION

1. Field of the Invention

The present invention relates to curtain cutting equipment, and more particularly to a curtain cutting aid.

2. Description of the Related Art

Commercial curtains are available in fixed sizes. Therefore, one curtain is simply suitable for one particular size of window. However, in recent years, in order to beautify the appearance of buildings, builders will usually design windows in special sizes, making the situation that curtains purchased from the market will not be applicable. At this time, custom made curtains are needed to fit these special window sizes. But this way will inevitably lead to increased costs.

For cost considerations, the current practice is to cut the curtain in accordance with the window size. During the cutting operation, a vise or like tool is normally used for holding down the curtain for cutting. Using a vise or other fixation tool to hold down the curtain in place for cutting can enhance the convenience of the cutting operation. However, it is time and labor consuming to cut the curtain in this manner. Further, the applied clamping force is instable. If the curtain is not tightly secured in place, the curtain can be biased or spread out during cutting. If an excessive clamping force is applied to the curtain, it can cause deformation of the curtain. This will also cause a certain degree of impact on the overall appearance of the curtain. Even a well trained person using these tools is difficult to maintain the smoothness of the appearance of the curtain after cutting.

SUMMARY OF THE INVENTION

The present invention has been accomplished under the circumstances in view. It is the main object of the present to provide a curtain cutting aid, which greatly enhances the convenience and precision of the cutting work, and effectively maintains the smoothness of the appearance of the curtain after cutting.

To achieve this and other objects of the present invention, a curtain cutting aid of the invention comprises a curtain holder and a positioning unit. The curtain holder comprises a first sidewall, a second sidewall opposite to the first sidewall, a top wall connected between the first sidewall and the second sidewall at a top side, a bottom wall connected between the first sidewall and the second sidewall at an opposing bottom side, an insertion space surrounded by the top wall, the bottom wall, the first sidewall and the second sidewall, an insertion slot transversely cut through the first sidewall in communication with the insertion space, a sliding slot disposed adjacent to the insertion slot, a cutting slot located in the top wall in vertical communication with the insertion space, and a positioning portion located in the insertion slot. The positioning unit comprises a movable bar, an operating knob and an elastic restoring member. The movable bar is movably inserted through the insertion slot in the first sidewall of the curtain holder into the insertion space, comprising a plurality of positioning grooves arranged in parallel on a top wall thereof The operating knob is mounted in the sliding slot of the curtain holder and movable between an initial position and a pressed position, comprising an opening disposed in communication with the insertion slot and coupled to the movable bar. The elastic restoring member is mounted in the sliding slot in the first sidewall of the curtain holder and stopped against a bottom edge of the operating knob to exert an elastic restoring force to the operating knob.

Thus, when the operating knob is not pressed, i.e., in the initial position, one the positioning groove of the movable bar is engaged in the positioning portion of the curtain holder, at this time, the movable bar is locked to hold the inserted curtain in the insertion space positively in position. On the contrary, when the operating knob is pressed, i.e., moved to the pressed portion, each the positioning groove of the movable bar is disengaged from the positioning portion of the curtain holder, at this time, the movable bar is unlocked and transversely movably adjusted to according to the size of the curtain to be cut.

Other advantages and features of the present invention will be fully understood by reference to the following specification in conjunction with the accompanying drawings, in which like reference signs denote like components of structure.

DETAILED DESCRIPTION OF THE INVENTION

Figure 1:
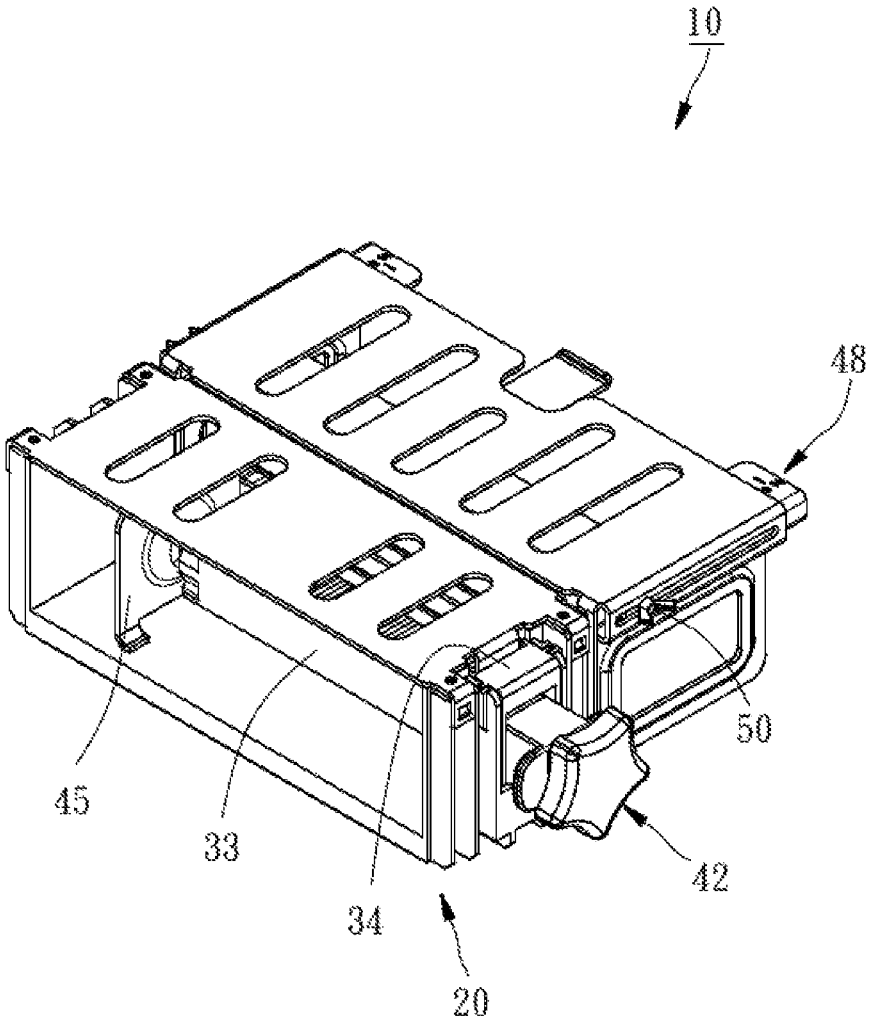
FIG. 1 is an oblique top elevational view of a curtain cutting aid in accordance with the present invention.
Figure 2:
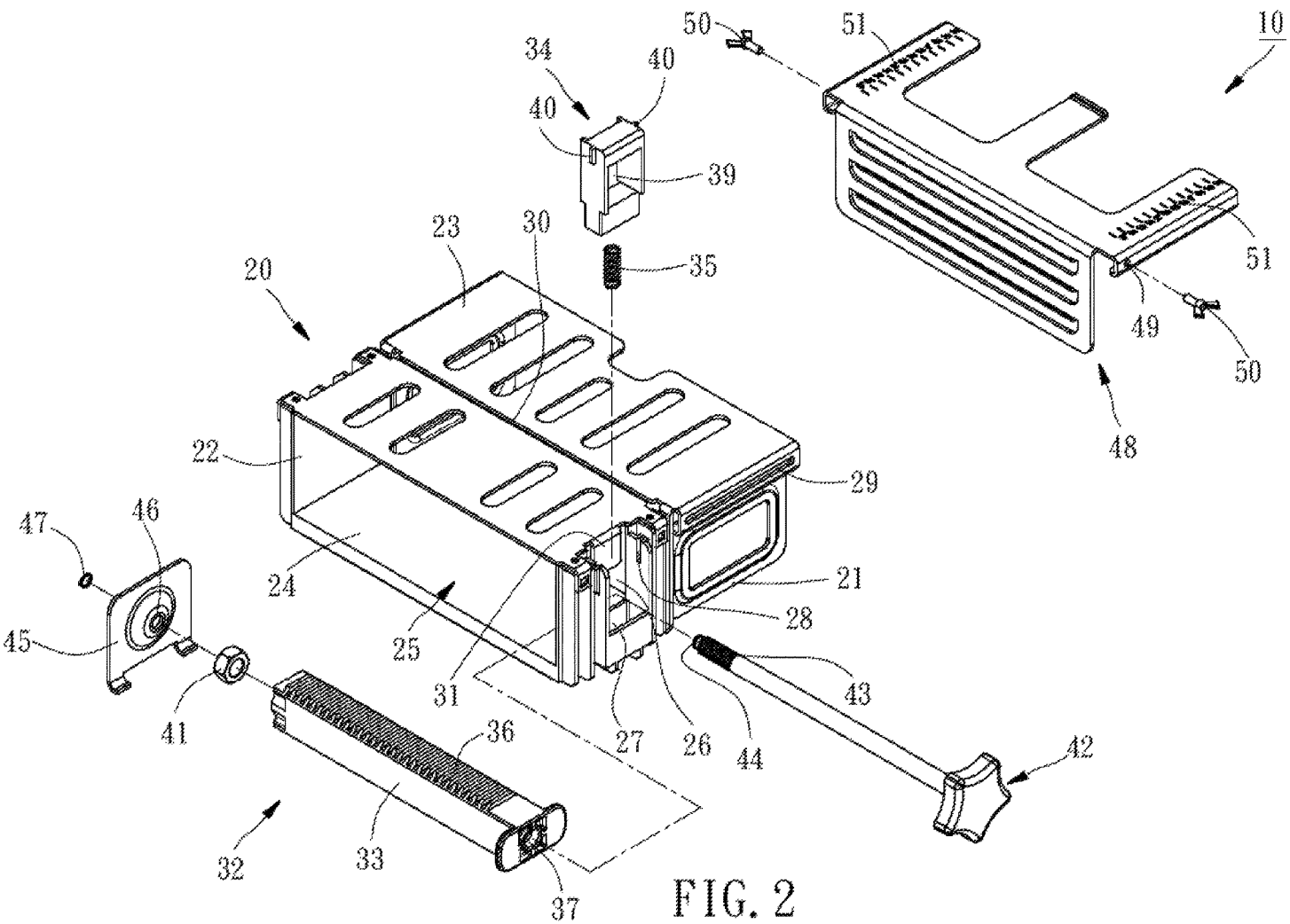
FIG. 2 is an exploded view of the curtain cutting aid in accordance with the present invention.
Figure 3:
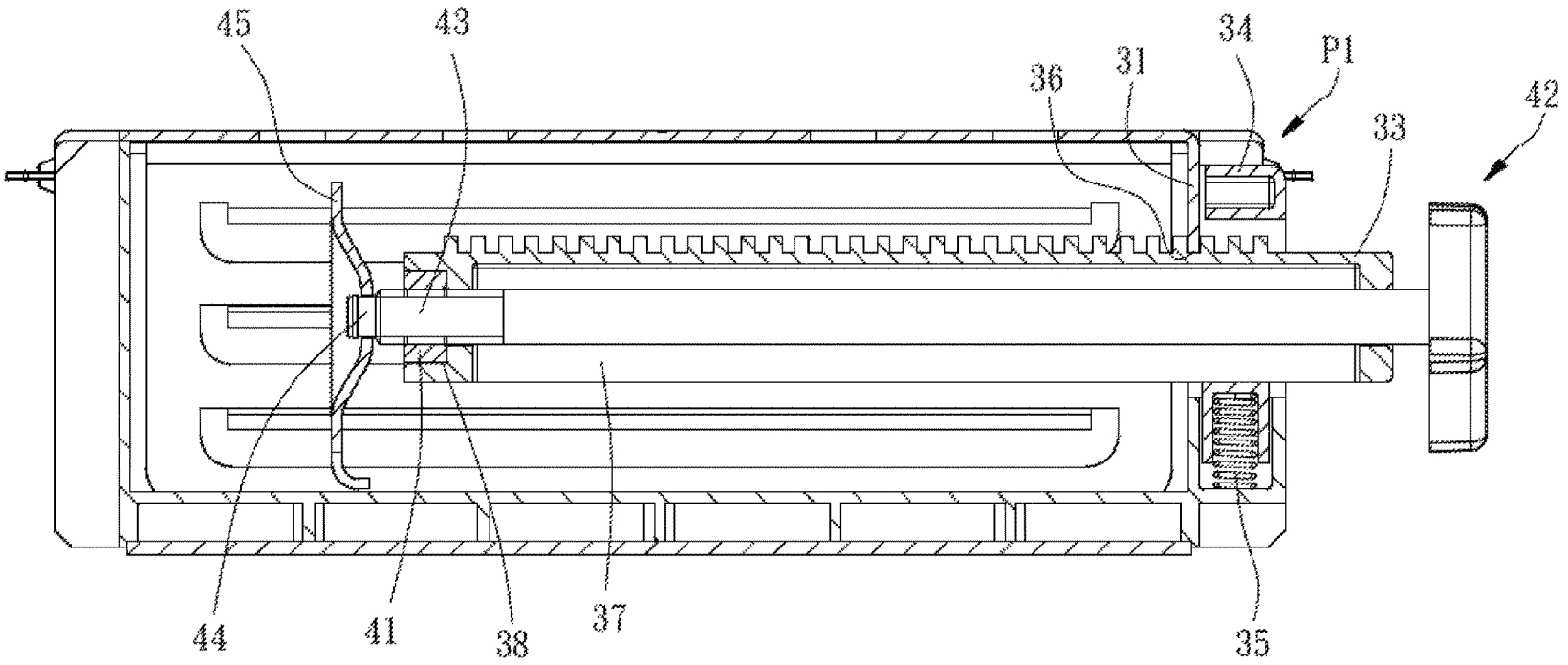
FIG. 3 is a sectional view of the present invention, illustrating the operating knob in the initial position.

Referring to FIGS. 1-3, a curtain cutting aid 10 in accordance with the present invention is shown. As illustrated, the curtain cutting aid 10 comprises a curtain holder 20, a positioning unit 32, and a baffle plate 48.

The curtain holder 20 comprises a first sidewall 21, a second sidewall 22 opposite to the first sidewall 21, a top wall 23 connected between the first sidewall 21 and the second sidewall 22 at a top side, a bottom wall 24 connected between the first sidewall 21 and the second sidewall 22 at a bottom side opposite to the top wall 23, an insertion space 25 surrounded by the top wall 23, the bottom wall 24, the first sidewall 21 and the second sidewall 22 for the insertion of a curtain, an insertion slot 26 transversely cut through the first sidewall 21 near a front end thereof and disposed in communication with the insertion space 25, a sliding slot 27 disposed adjacent to the insertion slot 26, two guide grooves 28 defined in the sliding slot 27 at two opposite sides, two elongated slots 29 respectively located in the first sidewall 21 and the second sidewall 22 near a rear side thereof, a cutting slot 30 located in the top wall 23 in vertical communication with the insertion space 25, and a positioning portion 31 extended from the top wall 23 to the insertion slot 26.

Figure 4:
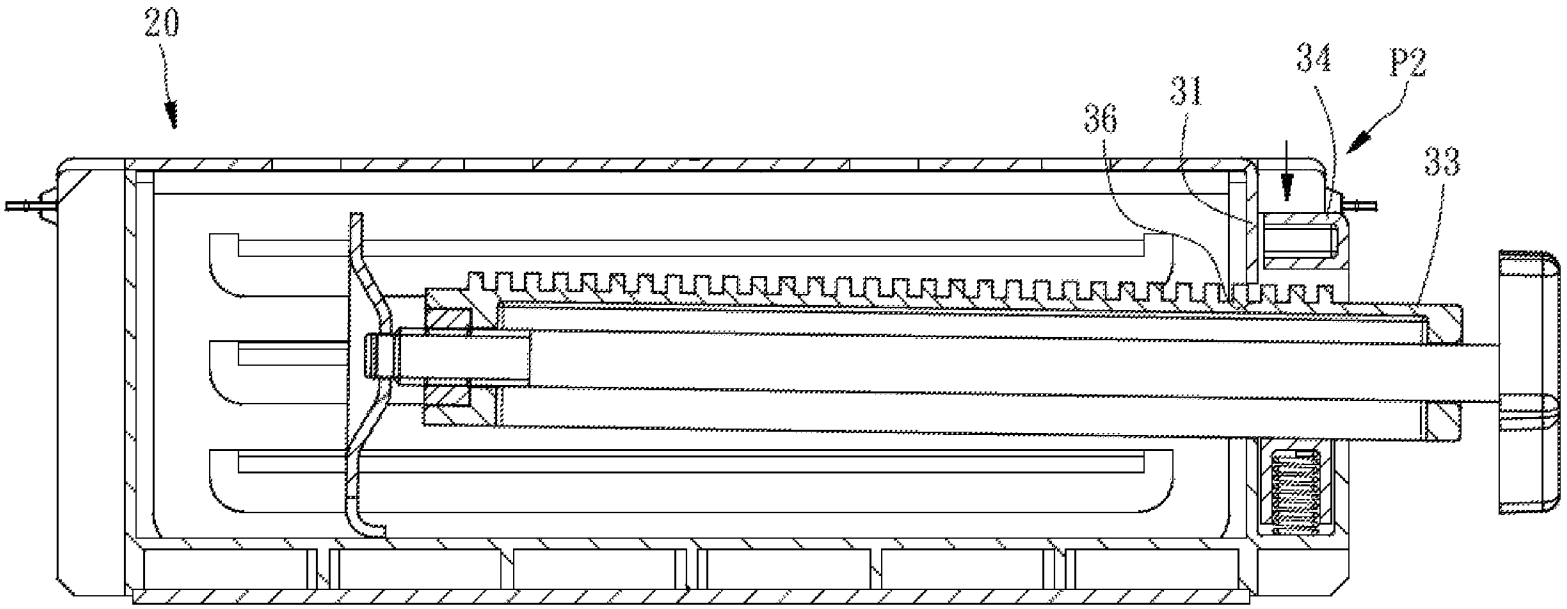
FIG. 4 is similar to FIG. 3, illustrating the operating knob in the pressed position.
Figure 5:
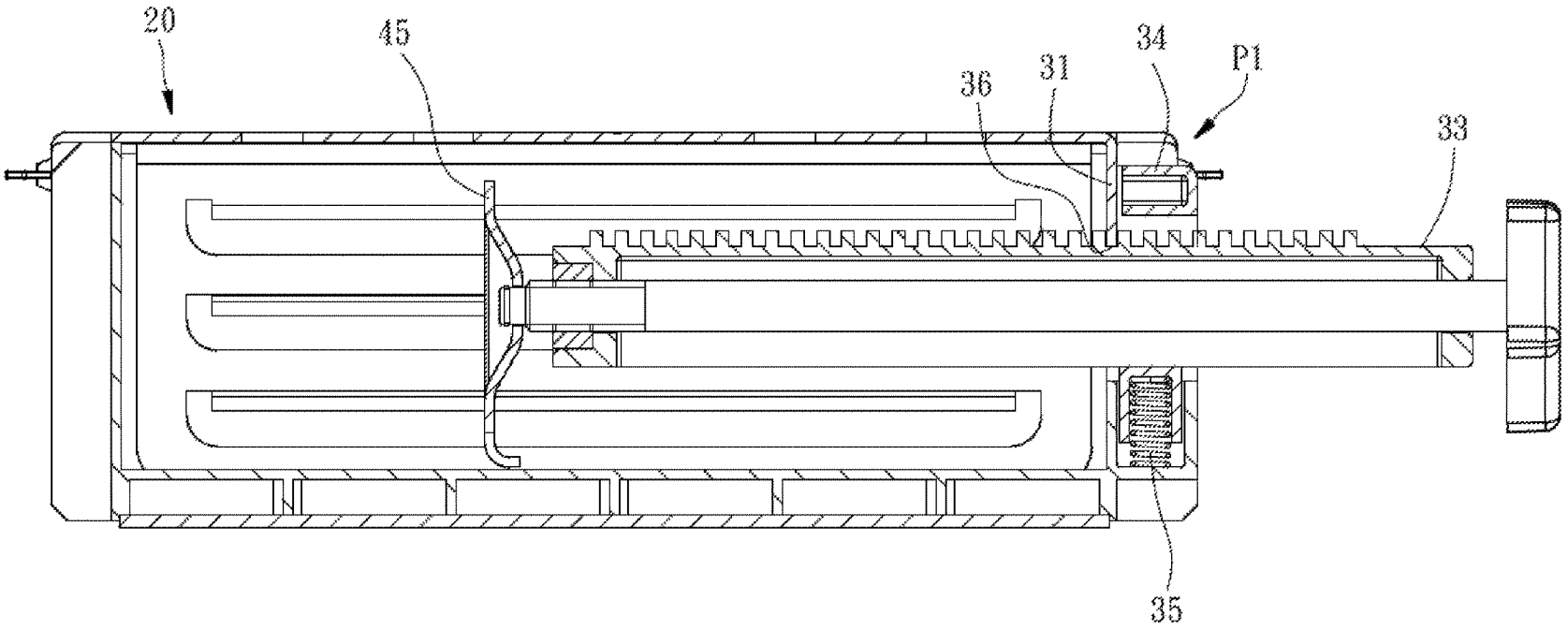
FIG. 5 is similar to FIG. 4, illustrating the position of the movable bar adjusted.

The positioning unit 32 comprises a movable bar 33, an operating knob 34, and an elastic restoring member 35. The movable bar 33 is inserted through the insertion slot 26 in the first sidewall 21 of the curtain holder 20 into the insertion space 25, comprising a plurality of positioning grooves 36 arranged in parallel on a top wall thereof, an axle hole 37 axially extended through opposing inner and outer ends thereof and a countersunk hole 38 located in the inner end in communication with the axle hole 37. The operating knob 34 is mounted in the sliding slot 27 of the curtain holder 20, comprising an opening 39 and two opposing guide portions 40. The operating knob 34 has the opening 39 thereof coupled to the movable bar 33, and the guide portions 40 thereof respectively engaged in the respective guide grooves 28 of the curtain holder 20, and thus, the operating knob 34 can be operated to move the movable bar 33 up and down between an initial position P1 and a pressed position P2. When the operating knob 34 is in the initial position P1 as shown in FIGS. 3 and 5, one positioning groove 36 of the movable bar 33 is inserted into the positioning portion 31 of the curtain holder 20. When the operating knob 34 is in the pressed position P2 as shown in FIG. 4, the positioning groove 36 of the movable bar 33 is moved out of the positioning portion 31 of the curtain holder 20. The elastic restoring member 35 is mounted in the sliding slot 27 of the curtain holder 20 and stopped against a bottom edge of the operating knob 34 to exert an elastic restoring to the operating knob 34, supporting the operating knob 34 in the initial position P1. The positioning unit 32 further comprises a screw nut 41, a hand screw 42, and a pressure plate 45. The screw nut 41 is fixedly mounted in the countersunk hole 38 of the movable bar 33. The hand screw 42 is rotatably inserted through the axle hole 37 of the movable bar 33, comprising a threaded shank portion 43 and a retaining portion 44 adjacent to the threaded shank portion 43. The hand screw 42 has the threaded shank portion 43 thereof threaded into the screw nut 41. The pressure plate 45 is set in the insertion space 25 of the curtain holder 20, comprising a locating hole 46 that is coupled to the retaining portion 44 of the hand screw 42 and secured thereto by a C-shaped retaining ring 47.

Figure 7:
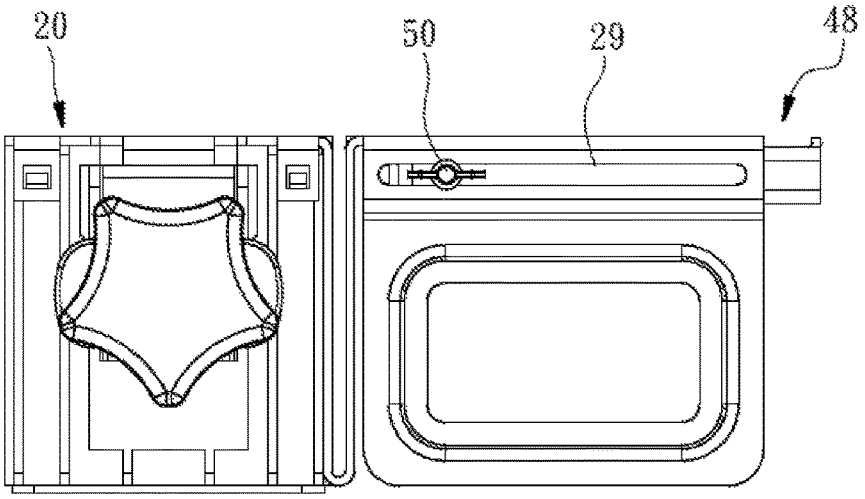
FIG. 7 is a side view of the curtain cutting aid in accordance with the present invention.
Figure 8:
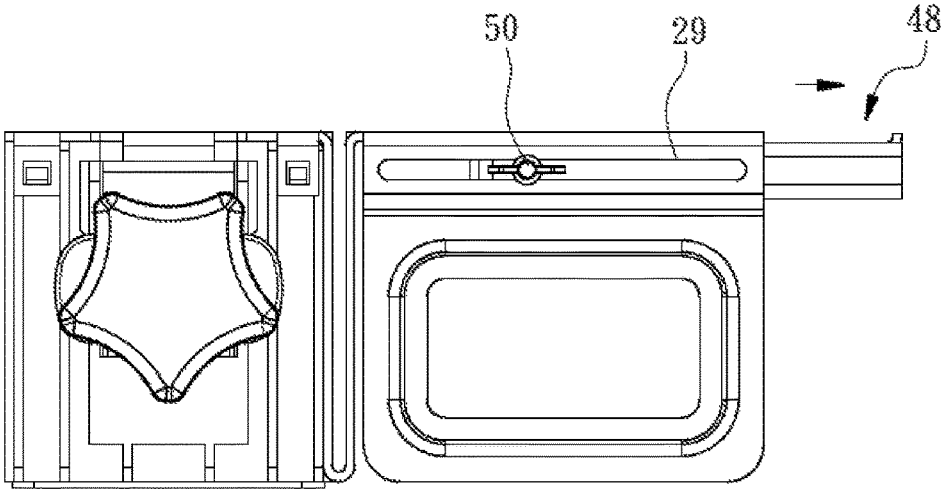
FIG. 8 is similar to FIG. 7, illustrating the position of the baffle plate adjusted.

Referring to FIGS. 7 and 8 and FIG. 2 again, the baffle plate 48 is movably mounted in the insertion space 25 of the curtain holder 20 for supporting the curtain to be cut, comprising a screw hole 49 at each of two opposite lateral sides thereof. Two wing screws 50 are respectively inserted through the elongated slots 29 in the first and second sidewalls 21, 22 of the curtain holder 20 and threaded into the respective screw holes 49 of the baffle plate 48 to lock the baffle plate 48 to the curtain holder 20. When loosened the wing screws 50, the user can move the baffle plate 48 forwardly or backwardly along the elongated slots 29 of the curtain holder 20 and then fasten tight the wing screws 50 to lock the baffle plate 48 to the curtain holder 20 in the adjusted position. The moving distance of the baffle plate 48 is equal to the length of the curtain to be cut. In order to facilitate measuring the cutting length of the curtain, graduations 51 are marked on a top wall of the baffle plate 48 for visual checking.

Figure 6:
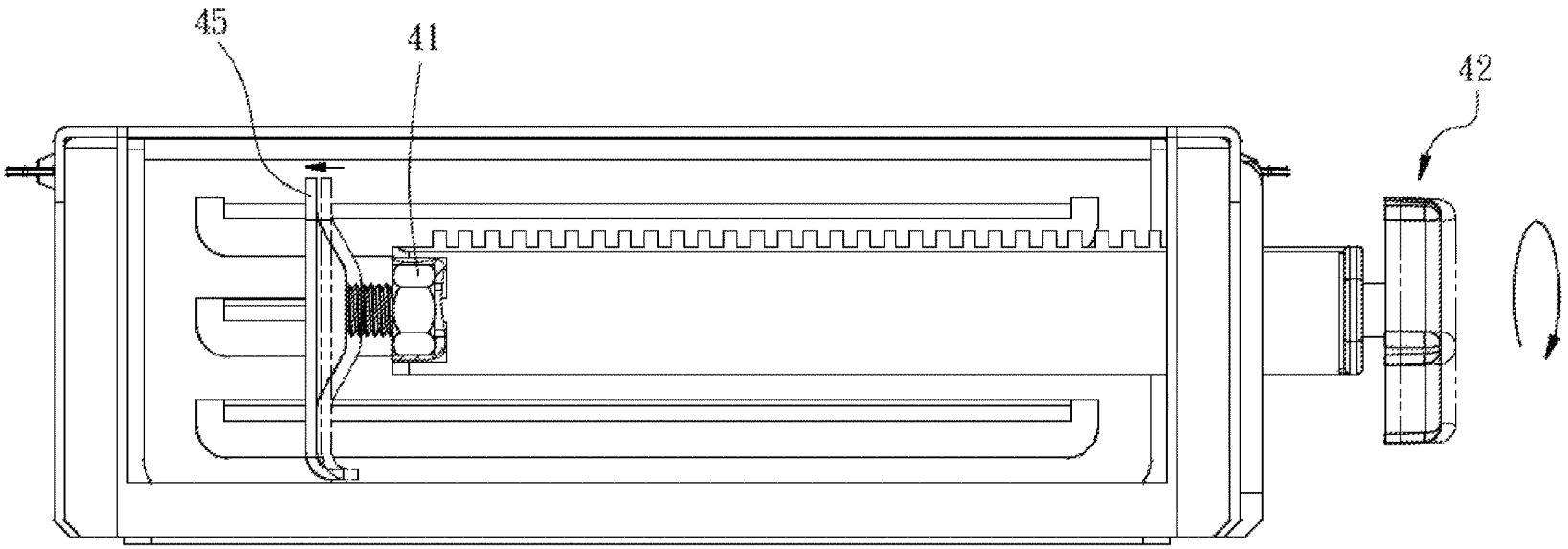
FIG. 6 is a sectional view of the present invention, illustrating fine adjustment of the position of the pressure plate adjusted.

When going to cut the curtain, insert the curtain into the insertion space 25 to have the curtain be stopped against the baffle plate 48, and then impart a downward pressure to the operating knob 34 to move the operating knob 34 from the initial position P1 to the pressed position P2 shown in FIG. 4 to disengage the positioning groove 36 of the movable bar 33 from the positioning portion 31 of the curtain holder 20. At this time, move the movable bar 33 according to the size of the curtain (see FIG. 4), and then release the pressure from the operating knob 34 after adjustment of the position of the movable bar 33. After released the pressure from the operating knob 34, the operating knob 34 is immediately returned by the elastic restoring member 35 to the initial position P1 shown in FIG. 5, where one positioning groove 36 of the movable bar 33 is engaged into the positioning portion 31 of the curtain holder 20 to prohibit the movable bar 33 from displacement, and the pressure plate 45 is forced against one side of the curtain to keep the curtain in position. Thereafter, rotate the hand screw 42, as shown in FIG. 6. During rotation of the hand screw 42, the pressure plate 45 is moved toward the curtain at fine scales to hold down the curtain positively in position. At this time, the user can operate a cutter (not shown) to move through the cutting slot 30, thereby cutting the curtain.

In conclusion, the curtain cutting aid 10 of the invention uses the operating knob 34 to control movement of the movable bar 33 and the hand screw 42 for fine adjustment to rapidly lock the curtain in position, allowing the user to cut off the curtain accurately and steadily, enhancing the convenience and precision of the cutting work and maintaining the smoothness of the appearance of the curtain.

What is claimed is:

1. A curtain cutting aid, comprising:

a curtain holder comprising a first sidewall, a second sidewall opposite to the first sidewall, a top wall connected between said first sidewall and said second sidewall at a top side, a bottom wall connected between said first sidewall and said second sidewall at an opposing bottom side, an insertion space surrounded by said top wall, said bottom wall, said first sidewall and said second sidewall, an insertion slot transversely cut through said first sidewall in communication with said insertion space, a sliding slot disposed adjacent to said insertion slot, a cutting slot located in said top wall in vertical communication with said insertion space and a positioning portion located in said insertion slot; and a positioning unit comprising a movable bar, an operating knob and an elastic restoring member, said movable bar being movably inserted through said insertion slot in said first sidewall of said curtain holder into said insertion space, said movable bar comprising a plurality of positioning grooves arranged in parallel on a top wall thereof, said operating knob being mounted in said sliding slot of said curtain holder and movable between an initial position and a pressed position, said operating knob comprising an opening disposed in communication with said insertion slot and coupled to said movable bar in such a manner that when said operating knob is in said initial position, one said positioning groove of said movable bar is engaged in said positioning portion of said curtain holder; when said operating knob is in said pressed portion, each said positioning groove of said movable bar is disengaged from said positioning portion of said curtain holder, said elastic restoring member being mounted in said sliding slot in said first sidewall of said curtain holder and stopped against a bottom edge of said operating knob to support said operating knob in said initial position.

2. The curtain cutting aid as claimed in claim 1, wherein said movable bar comprises an axle hole and a countersunk hole in communication with said axle hole;

said positioning unit further comprises a screw nut mounted in said countersunk hole of said movable bar, a hand screw inserted through said axle hole of said movable bar and threaded into said screw nut and a pressure plate fastened to a distal end of said hand screw and suspended in said insertion space of said curtain holder.

3. The curtain cutting aid as claimed in claim 1, wherein said curtain holder further comprises two opposing guide grooves located at said first sidewall adjacent two opposite sides of said sliding slot; said operating knob comprises two opposing guide portions respectively movable engageable in said guide grooves of said curtain holder.

4. The curtain cutting aid as claimed in claim 1, further comprising a baffle plate and two wing screws, wherein said baffle plate is movably set in said insertion space of said curtain holder, comprising two screw holes respectively located at two opposite lateral sides thereof; said curtain holder further comprises two elongated slots respectively located in said first sidewall and said second sidewall; said wing screws are respectively movably inserted through said elongated slots of said curtain holder and threaded into respective said screw holes of said baffle plate.

5. The curtain cutting aid as claimed in claim 4, wherein said baffle plate has a plurality of graduations marked thereon.

* * * * *